US008896503B2

(12) United States Patent
Handa et al.

(10) Patent No.: US 8,896,503 B2
(45) Date of Patent: Nov. 25, 2014

(54) IMAGE DISPLAY APPARATUS AND METHOD FOR DRIVING THE SAME

(75) Inventors: Tomoaki Handa, Tokyo (JP); Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 641 days.

(21) Appl. No.: 12/458,880

(22) Filed: Jul. 27, 2009

(65) Prior Publication Data

US 2010/0053226 A1 Mar. 4, 2010

(30) Foreign Application Priority Data

Sep. 1, 2008 (JP) ..... 2008-223226

(51) Int. Cl.
*G09G 3/30* (2006.01)
*G09G 3/32* (2006.01)

(52) U.S. Cl.
CPC ..... *G09G 3/3233* (2013.01); *G09G 2300/0842* (2013.01); *G09G 2310/0218* (2013.01)
USPC ..... 345/76; 345/204; 345/690; 345/694; 345/87; 345/92

(58) Field of Classification Search
USPC ..... 345/76, 690, 204
See application file for complete search history.

(56) References Cited

U.S. PATENT DOCUMENTS

| | | | | |
|---|---|---|---|---|
| 6,011,531 | A * | 1/2000 | Mei et al. | 345/92 |
| 7,382,384 | B2 * | 6/2008 | Winters et al. | 345/695 |
| 2006/0176250 | A1 * | 8/2006 | Nathan et al. | 345/76 |
| 2007/0290956 | A1 * | 12/2007 | Young et al. | 345/76 |

FOREIGN PATENT DOCUMENTS

| | | | |
|---|---|---|---|
| JP | 2001-343911 | A | 12/2001 |
| JP | 2003-255907 | A | 9/2003 |
| JP | 2004-077567 | A | 3/2004 |
| JP | 2004-286816 | A | 10/2004 |
| JP | 2006-003731 | A | 1/2006 |
| JP | 2006-098622 | | 4/2006 |
| JP | 2006-154822 | | 6/2006 |
| JP | 2007-017936 | A | 1/2007 |
| JP | 2007-133284 | | 5/2007 |
| JP | 2007-310311 | | 11/2007 |
| JP | 2008-033091 | A | 2/2008 |
| JP | 2008-122633 | A | 5/2008 |
| JP | 2008122633 | A * | 5/2008 |

OTHER PUBLICATIONS

Japanese Office Action issued Jul. 20, 2010 for corresponding Japanese Application 2008-223226.

* cited by examiner

*Primary Examiner* — Grant Sitta
(74) *Attorney, Agent, or Firm* — Rader, Fishman & Grauer PLLC

(57) ABSTRACT

The present invention sets power supply drive signals DS[1] and DS[2] at a power supply voltage Vcc in a timesharing for odd lines and their subsequent even lines and sets a write signal WS to correspond to the time division setting, thereby sharing a scan line of the write signal WS between the odd lines and the subsequent even lines.

23 Claims, 12 Drawing Sheets

IMAGE DISPLAY APPARATUS AND METHOD FOR DRIVING THE SAME

BACKGROUND OF THE INVENTION

1. Field of the Invention

The present invention relates to an image display apparatus and a method for driving the image display apparatus, and can be applied to an active matrix image display apparatus using organic EL (electro luminescence) devices, for example. The present invention sets a power supply drive signal for odd lines and their subsequent even lines at a power supply voltage in a timesharing and sets a write signal corresponding to the time division setting to share scan lines for the write signal between the odd lines and the subsequent even lines, thereby reducing an impedance of the scan lines as compared with a conventional case.

2. Description of the Related Art

In recent years, there have been actively developed active matrix image display apparatuses using organic EL devices. The image display apparatus using organic EL devices is an image display apparatus utilizing a light emission phenomenon of an organic thin film which emits a light in response to an applied electric field. The organic EL device can be driven at an applied voltage of 10 [V] or less. Thus, the image display apparatus of this type can reduce power consumption. The organic EL device is spontaneous light emission device. Thus, the image display apparatus of this type can be reduced in its weight and size without the need of a back light device. Further, the organic EL device is characterized in that a response speed is as fast as several μ seconds. Therefore, the image display apparatus of this type is characterized in that an afterimage rarely occurs at the time of animation display.

Specifically, as shown in FIG. 14, an active matrix image display apparatus 1 using organic EL devices arranges pixel circuits made of organic EL devices and drive circuits for driving the organic EL devices in a matrix to form a display unit 2. The image display apparatus 1 drives each pixel circuit by a signal line drive circuit 3 and a scan line drive circuit 4 arranged around the display unit via signal lines DTL and scan lines SL provided in the display unit 2, respectively, to display a desired image.

Japanese Patent Application Laid-Open No. 2007-310311 discloses therein a method for using two transistors to configure pixel circuits for the image display apparatus using organic EL devices. Thus, according to the method disclosed in Japanese Patent Application Laid-Open No. 2007-310311 Publication, a configuration of the image display apparatus can be simplified. Further, Japanese Patent Application Laid-Open No. 2007-310311 discloses therein a configuration for correcting a variation in threshold voltage of a drive transistor for driving the organic EL devices and a variation in mobility. Thus, according to the configuration disclosed in Japanese paten Application Laid-Open No. 2007-310311, it is possible to prevent a deterioration in image quality due to the variation in threshold voltage of the drive transistor and the variation in mobility.

There has been proposed in Japanese Patent Application Laid-Open No. 2007-133284 a configuration for performing a processing of correcting a variation in threshold voltage of a drive transistor several times in a divided manner. According to the configuration disclosed in Japanese Patent Application Laid-Open No. 2007-133284, also when a time to be assigned to tone setting of a pixel circuit is reduced due to highly accurate configuration, it is possible to assign a sufficient time for correcting the variation in threshold voltage.

Therefore, also in the highly accurate configuration, it is possible to prevent a deterioration in image quality due to the variation in threshold voltage.

Further, Japanese Patent Application Laid-Open No. 2006-98622 discloses therein a configuration for creating a wiring of a display unit by a different wiring layer from each electrode of a transistor configuring a pixel circuit and reducing the wiring in its resistance.

Further, Japanese Patent Application Laid-Open No. 2006-154822 discloses therein a configuration for arranging scan line drive circuits on both sides of a display unit and dividing the drive of each pixel circuit into the scan line drive circuits at both sides

SUMMARY OF THE INVENTION

As shown by symbol "A" in FIG. 14, a scan line SL is a transmission path by a distribution constant circuit for resistance and capacity. Thus, the image display apparatus 1 gradually dulls a signal waveform of a drive signal as it is moving away from a scan line drive circuit 4 as shown by symbols "B" and "C". When the signal waveform remarkably dulls, the image display apparatus 1 is difficult to accurately set the tone in each pixel circuit, which consequently causes an issue that shading occurs in a display screen.

As one method for solving the issue, there is considered a method for applying the method disclosed in Japanese Patent Application Laid-Open No. 2006-98622 to reduce an impedance of the scan line. However, the method has an issue that a manufacturing step is complicated. The method disclosed in Japanese Patent Application Laid-Open No. 2006-154822 may be employed, but in this case the number of scan line drive circuits increases, which makes the configuration complicated.

The present invention has been therefore made in views of the above issues, and proposes an image display apparatus and a method for driving the same capable of reducing an impedance of scan lines than ever before.

According to an embodiment of the present invention, there is provided an image display apparatus including: a display unit formed such that pixel circuits are arranged in a matrix; a signal line drive circuit for outputting a signal line drive signal to signal lines of the display unit; and a scan line drive circuit for outputting a power supply drive signal and a write signal to power supply scan lines and write scan lines of the display unit, wherein the pixel circuit at least includes: light emission devices; a drive transistor for driving the light emission devices by a drive current corresponding to a gate/source voltage; a storage capacitor for holding the gate/source voltage; and a write transistor for setting a voltage of one end of the storage capacitor at a voltage of the signal line drive signal, alternately repeats a light emission period when the light emission devices emit a light and a light non-emission period when the light emission devices stop light emission, sets an inter-terminal voltage of the storage capacitor by the signal line drive signal through control of the write transistor by the write signal in the light non-emission period and sets a light emission luminance of the light emission devices in a subsequent light emission period, and drives the light emission devices in the drive transistor by a power supply voltage supplied by the power supply drive signal in the light emission period, the write scan line is shared between odd lines and subsequent even lines, the scan line drive circuit sets the power supply drive signal for the odd lines and the power supply drive signal for the subsequent even lines at the power supply voltage in a timesharing, and sets the write signal corresponding to the setting of the power supply voltage in a timesharing and performs the setting of light emission luminance of the light emission devices in a timesharing for the odd lines and the subsequent even lines.

According to the embodiments of the present invention described above, there is applied a method for driving an image display apparatus having: a display unit formed such that pixel circuits are arranged in a matrix; a signal line drive circuit for outputting a signal line drive signal to signal lines of the display unit; and a scan line drive circuit for outputting a power supply drive signal and a write signal to power supply scan lines and write scan lines of the display unit. The pixel circuit at least includes: light emission devices; a drive transistor for driving the light emission devices by a drive current corresponding to a gate/source voltage; a storage capacitor for holding the gate/source voltage; and a write transistor for setting a voltage of one end of the storage capacitor at a voltage of the signal line drive signal, alternately repeats a light emission period when the light emission devices emit a light and a light non-emission period when the light emission devices stop light emission, sets an inter-terminal voltage of the storage capacitor by the signal line drive signal through control of the write transistor by the write signal in the light non-emission period and sets a light emission luminance of the light emission devices in a subsequent light emission period, and drives the light emission devices in the drive transistor by a power supply voltage supplied by the power supply drive signal in the light emission period. The method for driving the image display apparatus including the steps of: sharing the write scan line between odd lines and subsequent even lines; setting the power supply drive signal for the odd lines and the power supply drive signal for the subsequent even lines at the power supply voltage in a timesharing; and setting the write signal corresponding to the setting of the power supply voltage in a timesharing and performing the setting of light emission luminance of the light emission devices in a timesharing for the odd lines and the subsequent even lines.

With such configuration, the power supply drive signal for odd lines and their subsequent even lines is set at the power supply voltage in a timesharing and the write signal is set to correspond to the time division setting so that the tone setting processing for light emission devices is performed in a timesharing for odd lines and their subsequent even lines and the light emission period can be set in a timesharing. Thus, the scan lines of the write signal (write scan lines) can be shared between the odd lines and their subsequent even lines and the scan line is created to be wide by the sharing, thereby reducing an impedance of the scan lines than ever before.

According to the embodiments of the present invention described above, it is possible to reduce an impedance of the scan lines than ever before.

DETAILED DESCRIPTION OF THE PREFERRED EMBODIMENTS

Figures 1A, 1B, 1C, 1D, 1E, 1F, 1G:
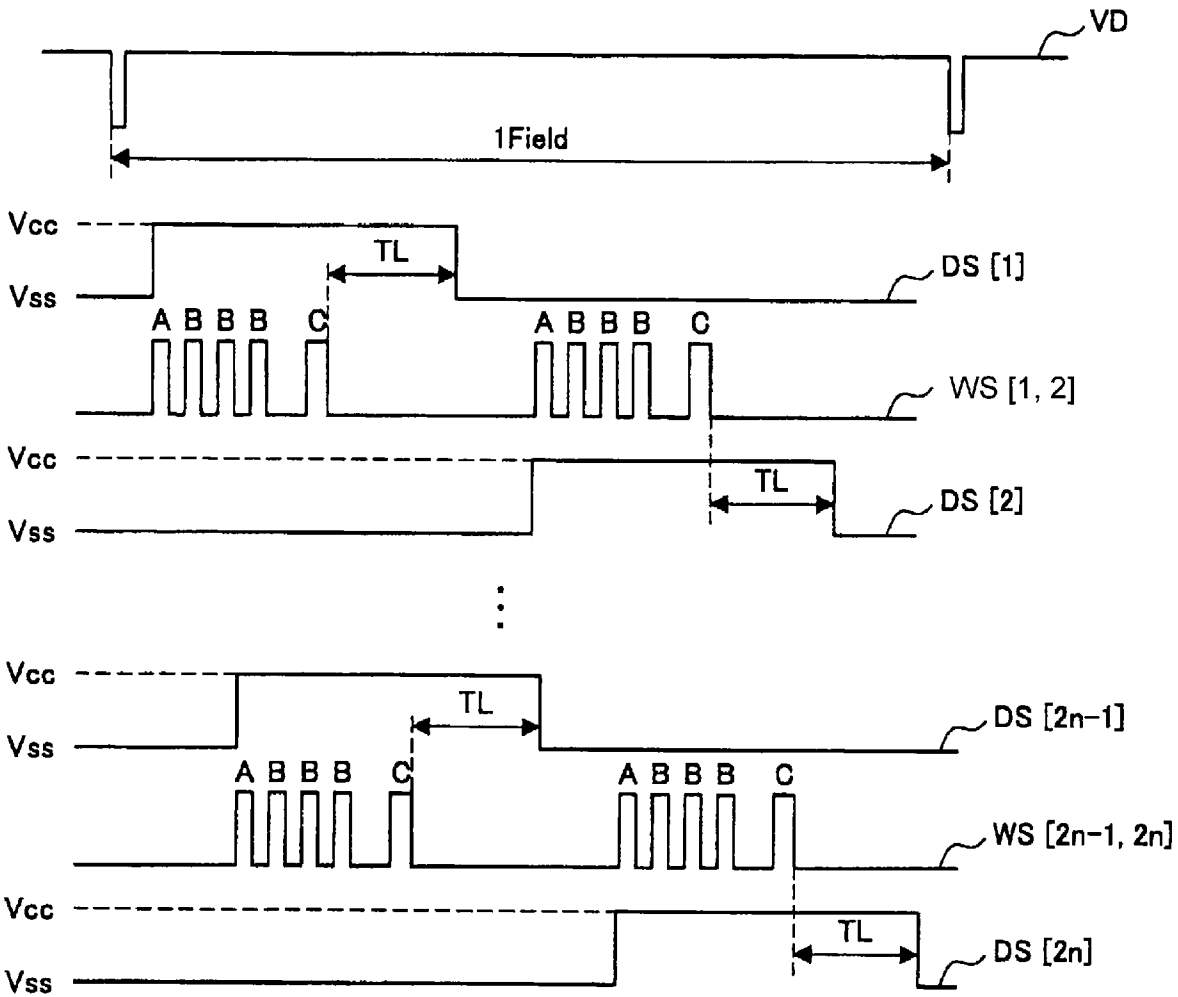
FIGS. 1A-1G are time charts for explaining an operation of an image display apparatus according to an embodiment of the present invention.

Hereafter, preferred embodiments of the present invention will be described in detail with reference to the appended drawings. Note that in this specification and the appended drawings, structural elements that have substantially the same functions and structures are denoted with the same reference numerals and a repeated explanation of these structural elements is omitted.

Hereinafter, an embodiment of the present invention will be described in detail with reference to the drawings as needed. The explanation will be made in the following order.

1. First embodiment
2. Variants

First Embodiment

Configuration of Embodiment

[Entire Configuration]

Figure 2:
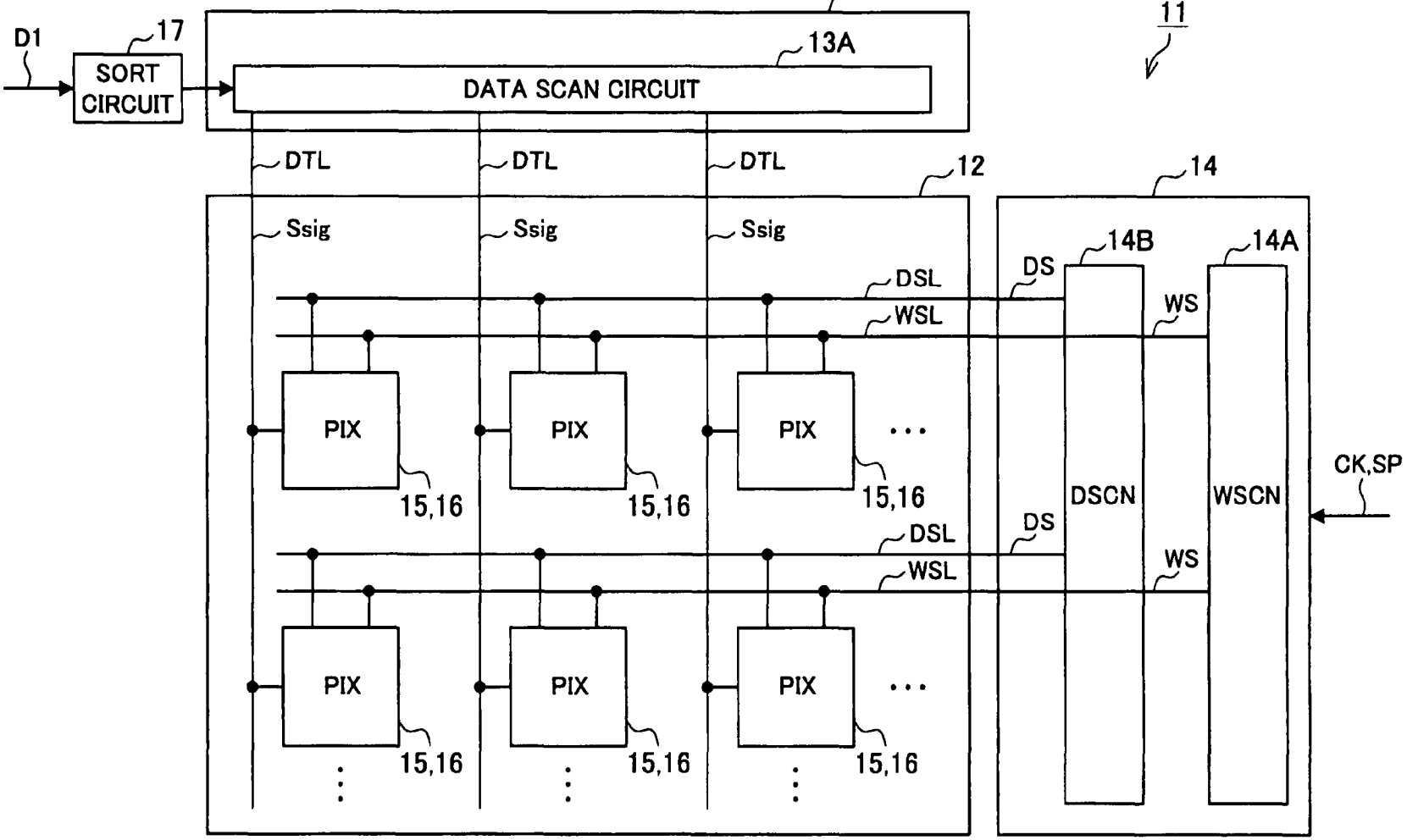
FIG. 2 is a block diagram showing the image display apparatus according to the embodiment of the present invention.

FIG. 2 is a block diagram showing an image display apparatus according to the first embodiment of the present invention. The image display apparatus 11 forms therein a display unit 12 on an insulative substrate such as glass. In the image display apparatus 11, a signal line drive circuit 13 and a scan line drive circuit 14 are formed around the display unit 12.

The display unit 12 is formed in which pixel circuits 15 are arranged in a matrix, and organic EL devices provided in the pixel circuits 15 form pixels (PIX) 16. Since one pixel is configured with a plurality of sub-pixels such as red, green and blue in the image display apparatus for color image, in the case of the image display apparatus for color image, the pixel circuits 15 for red, green and blue, which constitute the red, green and blue sub-pixels, respectively, are sequentially arranged to form the display unit 12.

The signal line drive circuit 13 outputs a drive signal Ssig for signal line to signal lines DTL provided in the display unit 12. More specifically, the signal line drive circuit 13 sequentially latches and divides sequentially-input image data D1 into each signal line DTL in a data scan circuit 13A, and then performs a D/A conversion processing, respectively. The signal line drive circuit 13 processes the D/A conversion result to generate a drive signal Ssig.

The scan line drive circuit 14 outputs a write signal WS and a drive signal DS to write signal scan lines WSL and power supply scan lines DSL provided in the display unit 12, respectively. The write signal WS is directed for ON/OFF-controlling a write transistor provided in each pixel circuit 15. The drive signal DS is directed for controlling a drain voltage of a drive transistor provided in each pixel circuit 15. The scan line drive circuit 14 performs a clock CK processing on a predetermined sampling pulse SP to generate the write signal WS and the drive signal DS in a write scan circuit (WSCN) 14A and a drive scan circuit (DSCN) 14B, respectively.

A sort circuit 17 reorders the image data D1 input in the raster scan order, for example, in the order suitable for the processing in the image display apparatus 11, and outputs the same.

[Principle Configuration of Pixel Circuit]

Figure 3:
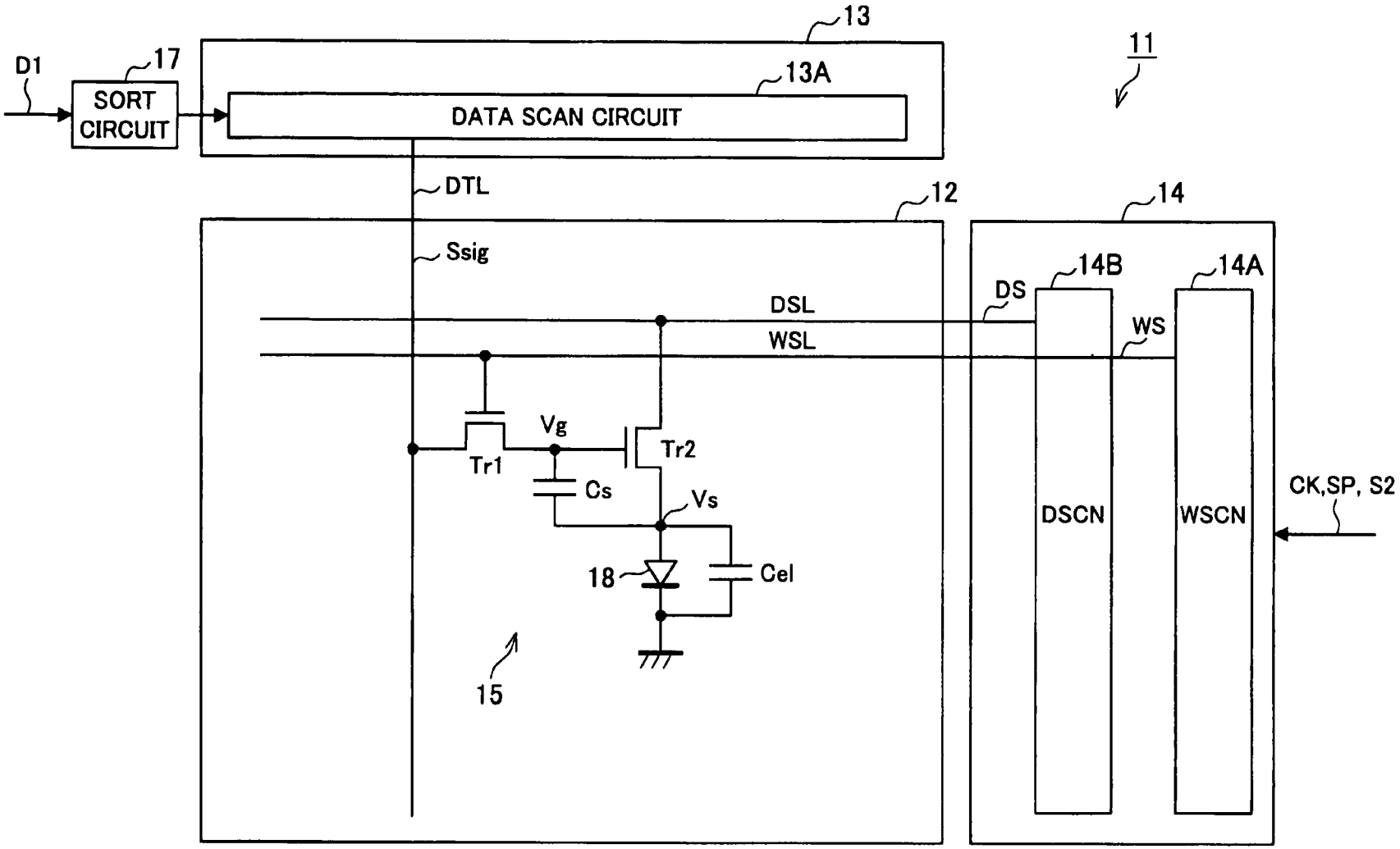
FIG. 3 is a connection diagram showing a configuration of a pixel circuit of the image display apparatus of FIG. 2.

FIG. 3 is a connection diagram showing the configuration of the pixel circuit 15 in detail. In the pixel circuit 15, a cathode of an organic EL device 18 is set at a predetermined negative voltage, and in the example of FIG. 3, the negative voltage is set at a voltage of an earth line. The pixel circuit 15 is connected at its anode of the organic EL device 18 to a source of a drive transistor Tr2. The drive transistor Tr2 is an N-channel transistor of TFT, for example. The pixel circuit 15 is connected at a drain of the drive transistor Tr2 to a power supply scan line DSL, and the scan line DSL is supplied with the power supply drive signal DS from the scan line drive circuit 15. Thus, the pixel circuit 15 uses the drive transistor Tr2 having a source follower circuit configuration to current-drive the organic EL device 18. In FIG. 3, a capacity Cel is a floating capacity of the organic EL device 18.

The pixel circuit 15 provides a storage capacitor Cs for holding a gate/source voltage Vgs of the drive transistor Tr2 between the gate and the source of the drive transistor Tr2. In the pixel circuit 15, a gate-end voltage of the storage capacitor Cs is set at a voltage of the drive signal Ssig through the control by the write signal WS. Consequently, the pixel circuit 15 current-drives the organic EL device 18 by the drive transistor Tr2 at the gate/source voltage Vgs corresponding to the drive signal Ssig.

In other words, the pixel circuit 15 is connected at the gate of the drive transistor Tr2 to the signal line DTL via the write transistor Tr1 which ON/OFF-operates in response to the write signal WS. The write transistor Tr1 is an N-channel transistor of TFT, for example.

Figures 4A, 4B, 4C, 4D, 4E:
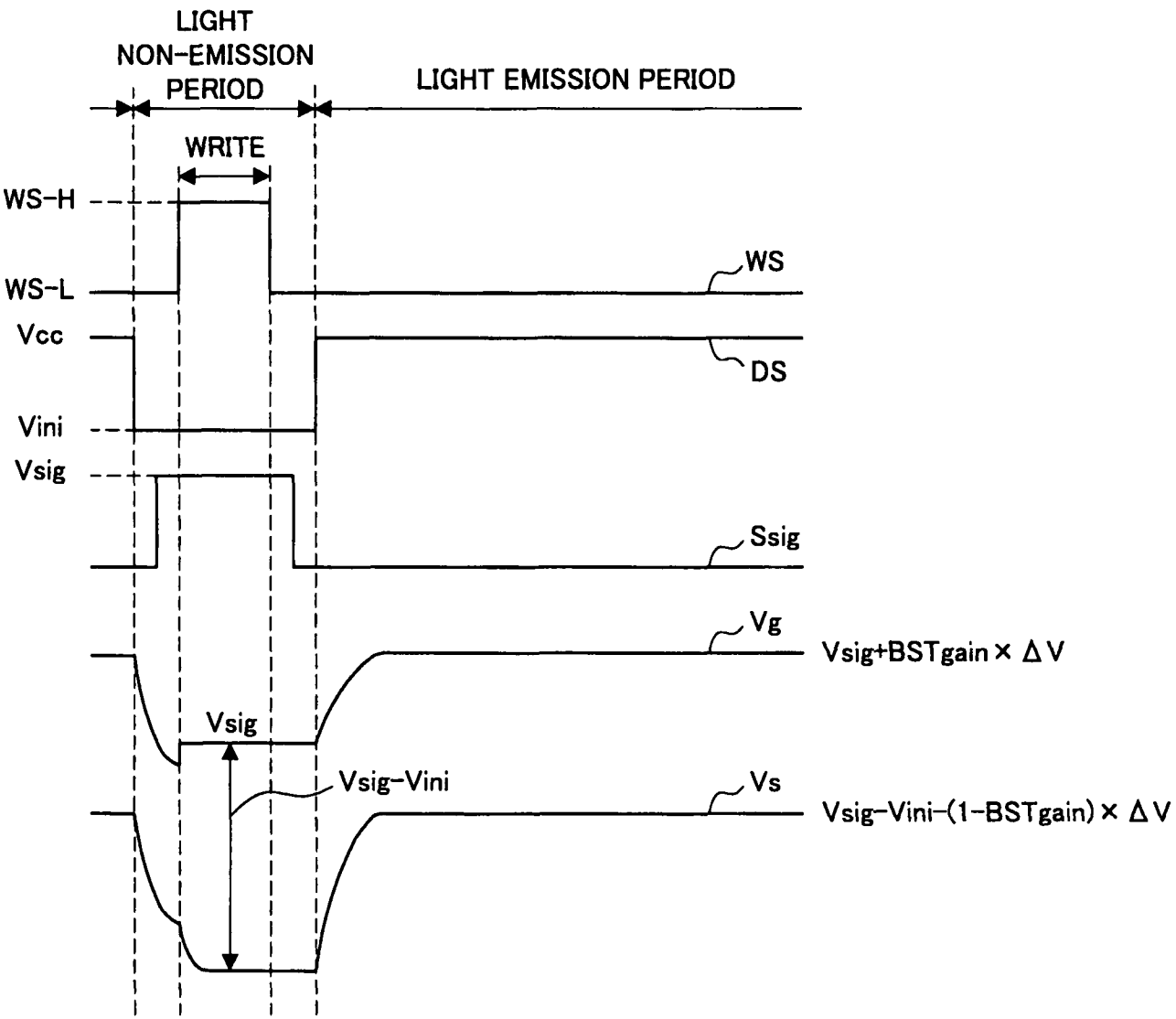
FIGS. 4A-4E are time charts for explaining a basic operation of the pixel circuit of FIG. 3.

FIG. 4 is a time chart for explaining a basic operation of the pixel circuit 15. The pixel circuit 15 drives the organic EL device 18 by the drive transistor Tr2 while the power supply drive signal DS rises up to a power supply voltage Vcc (FIG. 4B). Thus, in the example of FIG. 4, the organic EL device 18 emits a light while the power supply drive signal DS is rising up to the power supply voltage Vcc.

Figure 5:
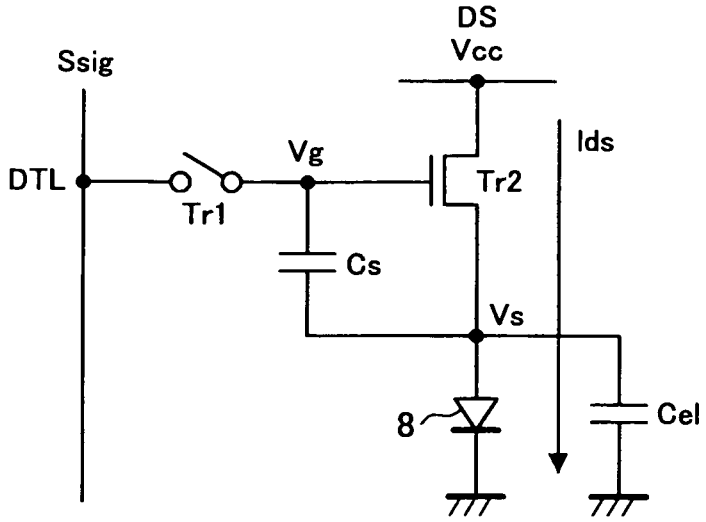
FIG. 5 is a connection diagram for explaining the time chart of FIG. 4.

In the light emission period, the pixel circuit 15 is set at the OFF state for the write transistor Tr1 by the write signal WS (FIG. 4A). Thus, the pixel circuit 15 causes the organic EL device 18 to emit a light at a drive current Ids corresponding to the gate/source voltage Vgs (FIGS. 4D and 4E) of the drive transistor Tr2 as an inter-terminal voltage of the storage capacitor Cs during the light emission period as shown in FIG. 5. The drive current Ids is expressed by the following Formula 1. In the Formula 1, Vth denotes a threshold voltage of the drive transistor Tr2 and μ denotes a mobility of the drive transistor Tr2. Further, "W" and "L" denote a channel width and a channel length of the drive transistor Tr2, respectively, and Cox denotes a capacity of a gate insulator per unit area of the drive transistor Tr2.

$$I_{ds} = \frac{1}{2}\mu\frac{W}{L}C_{ox}(V_{gs} - V_{th})^2 \quad \text{[Formula 1]}$$

When the power supply drive signal DS falls down to a voltage Vini, the pixel circuit 15 stops the supply of the power to the drive transistor Tr2. The fixed voltage Vini is low enough to cause the drain of the drive transistor Tr2 to function as a source, and is lower than the cathode voltage of the organic EL device 18. Therefore, the period when the power supply drive signal DS is fallen down to the voltage Vini is a light non-emission period when the organic EL device 18 stops the light emission.

Figure 6:
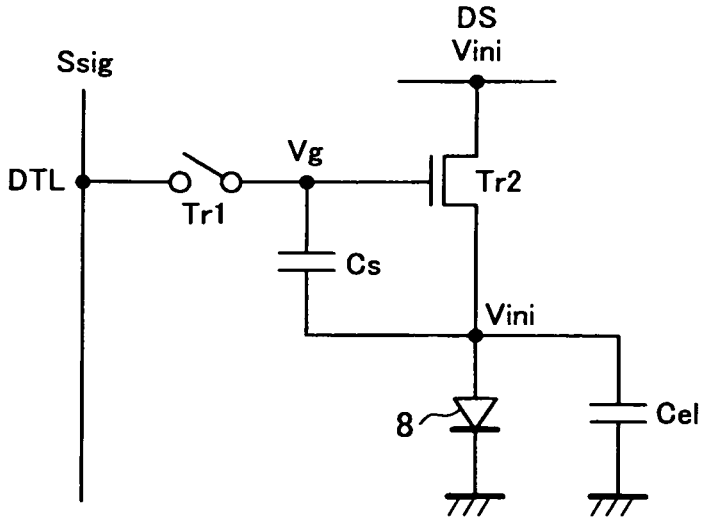
FIG. 6 is a connection diagram for explaining the time chart subsequent to FIG. 5.

When the light non-emission period starts, the power supply drive signal DS falls down to the voltage Vini in the pixel circuit 15 so that accumulated charges held in the source end of the drive transistor Tr2 are flown to the scan line DSL. Consequently, the source voltage Vs of the drive transistor Tr2 falls down around the voltage Vini in the pixel circuit 15 as shown in FIG. 6 so that the organic EL device 18 stops the light emission (FIG. 4C). Along with the falling of the source voltage Vs, the gate voltage Vg of the drive transistor Tr2 falls down (FIG. 4D).

Figure 7:
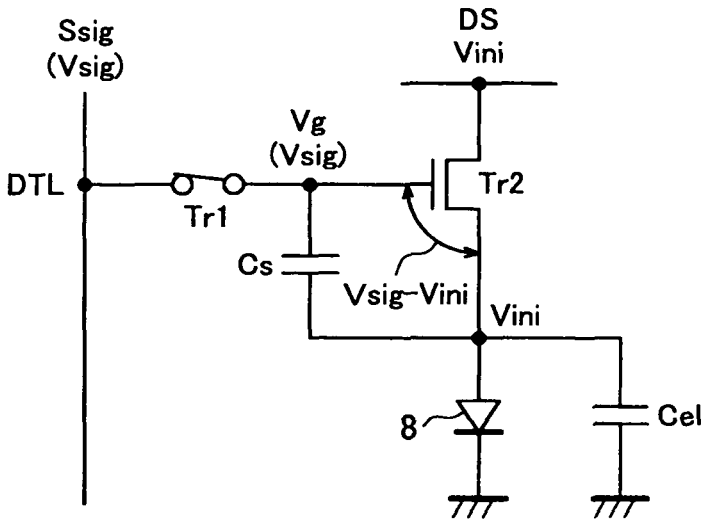
FIG. 7 is a connection diagram for explaining the time chart subsequent to FIG. 6.

The pixel circuit 15 is subsequently set at the tone setting voltage Vsig at which the voltage of the signal line DTL designates the light emission luminance of the organic EL device 18 by the scan line drive circuit 14 during the light non-emission period (FIG. 4C), and is set at the ON state for the write transistor Tr1 by the write signal WS (FIG. 4D). Thus, in the pixel circuit 15, the inter-terminal voltage of the storage capacitor Cs is set at a voltage (Vsig-Vini) corresponding to the tone setting voltage Vsig as shown in FIG. 7, and the light emission luminance of the organic EL device 18 is set during a subsequent light emission period.

Figure 8:
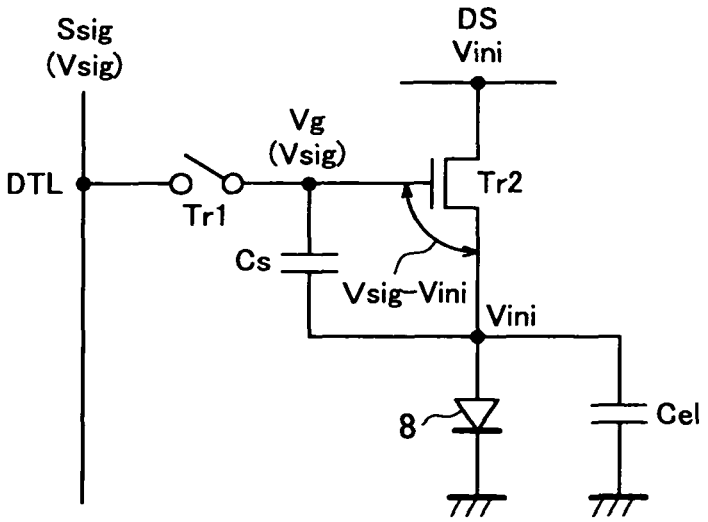
FIG. 8 is a connection diagram for explaining the time chart subsequent to FIG. 7.
Figure 9:
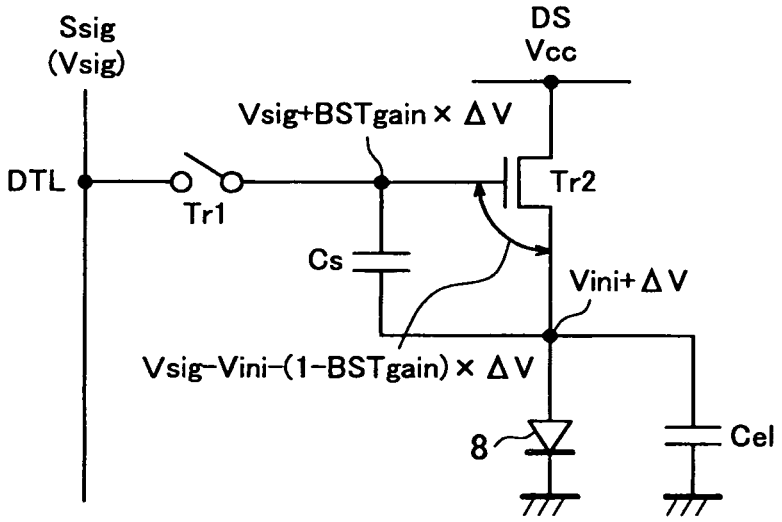
FIG. 9 is a connection diagram for explaining the time chart subsequent to FIG. 8.

In the pixel circuit 15, subsequently as shown in FIG. 8, after the write transistor Tr1 is set at the OFF state by the write signal WS, the power supply drive signal DS rises to the power supply voltage Vcc so that the light emission period starts as shown in FIG. 9. When the light emission period starts in the pixel circuit 15, the gate voltage Vg and the source voltage Vs of the drive transistor Tr2 rise by a so-called boot strap circuit. (1−BSTgain)×ΔV and BSTgain×ΔV in FIG. 8 are the amounts of increased voltage of the source voltage Vs and the gate voltage Vg by the boot strap circuit, respectively.

[Specific Configuration of Pixel Circuit]

The transistors Tr1, Tr2 constituting the pixel circuit 15 are configured with TFT (Thin Film Transistor), and TFT has a drawback that variations in threshold voltage Vth and mobility μ are large. When the threshold voltage Vth and the mobility μ vary as expressed in the Formula (1) in the pixel circuit 15, the drive current Ids varies against the gate/source voltage Vgs set for the storage capacitor Cs. Consequently, the light emission luminance varies in each pixel circuit 15 of the display unit 12, leading to a remarkable deterioration in image quality.

Thus, the pixel circuit 15 performs a variation correction processing on the threshold voltage Vth and the mobility μ to repeat the light emission period and the light non-emission period as specifically shown in FIG. 10 based on the comparison with FIG. 4.

Figures 10A, 10B, 10C, 10D, 10E, 10F:
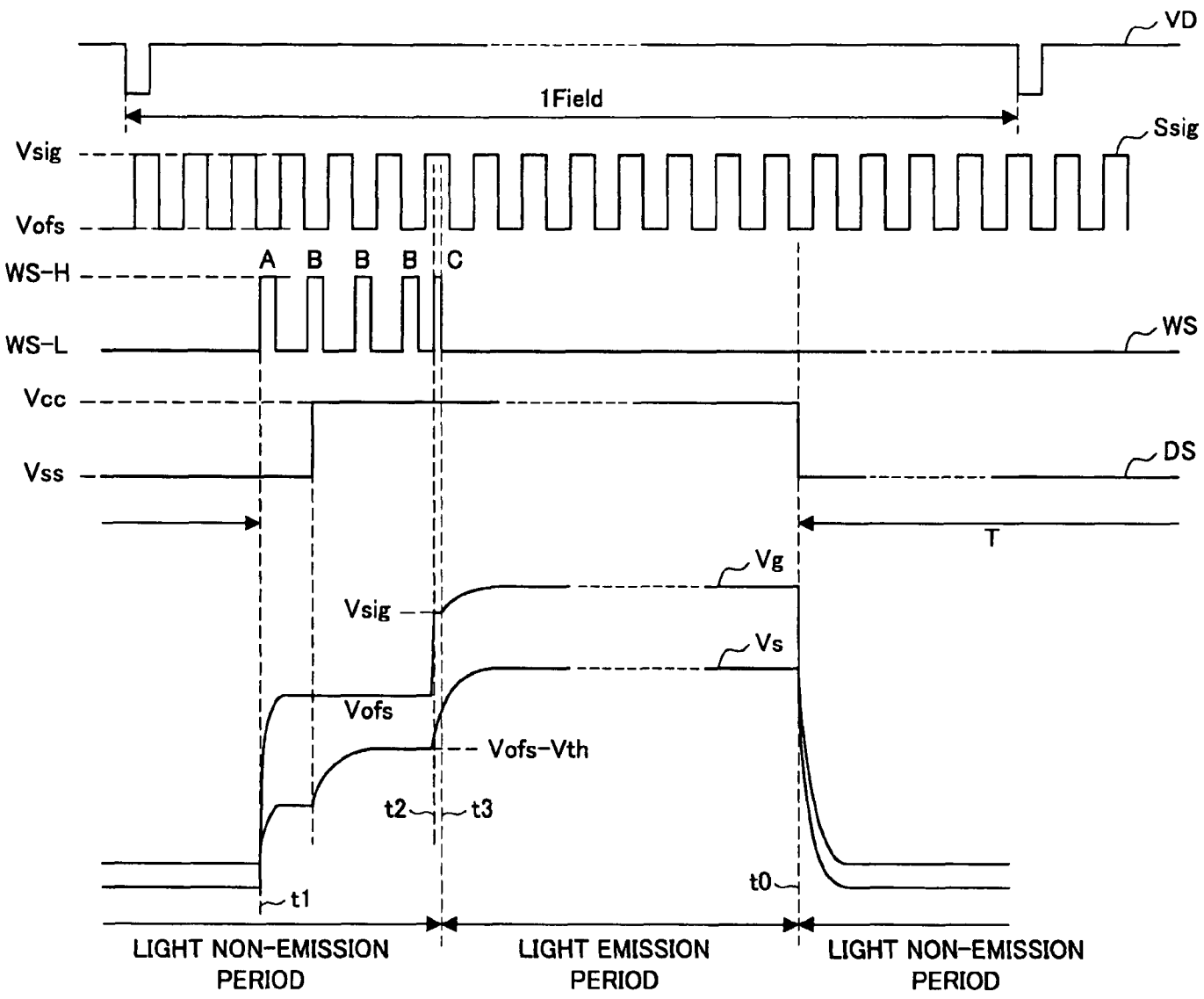
FIGS. 10A-10F are signal waveform diagrams for explaining an operation of a specific pixel circuit.

In other words, in the configuration of FIG. 10, the signal line drive circuit 13 outputs the tone setting voltage Vsig of each pixel circuit 15 connected to each scan line DTL across the correction voltage Vofs for the threshold voltage (FIG. 10B). The fixed voltage Vofs for the threshold voltage correction is a fixed voltage used for correcting a variation in the threshold voltage of the drive transistor Tr2. The tone setting voltage Vsig is directed for designating the light emission luminance of the organic EL device 8, and is obtained by adding the fixed voltage Vofs for threshold voltage correction to the tone voltage Vin. The tone voltage Vin corresponds to the light emission luminance of the organic EL device 8. At the tone voltage Vin, the image data D1 divided into each signal line DTL is subjected to the D/A conversion processing to be generated for each signal line DTL. In FIG. 10, VD (FIG. 10A) is a vertical synchronization signal.

When the light non-emission period starts at point t0, the power supply drive signal DS falls down to a predetermined fixed voltage Vss in the pixel circuit 15 (FIG. 10D). The fixed voltage Vss is low enough to cause the drain of the drive transistor Tr2 to function as a source, and is lower than the cathode voltage of the organic EL device 8.

Thus, in the pixel circuit 15, the accumulated charges at the source end of the drive transistor Tr2 are flown to the scan line DSL via the drive transistor Tr2 and the source voltage Vs of the drive transistor Tr2 falls down around the voltage Vss (FIG. 10F). Along with the falling of the source voltage Vs, the gate voltage Vg of the drive transistor Tr2 falls down (FIG. 10E).

In the pixel circuit 15, thereafter, the write transistor Tr1 is set at the ON state by the write signal WS at point t1 where the voltage of the signal line DTL is set at the fixed voltage Vofs (FIG. 10C), and the gate-end voltage of the storage capacitor Cs is set at the voltage Vofs. Thus, in the pixel circuit 15, the gate/source voltage Vgs of the drive transistor Tr2 is set at the voltage Vofs-Vss. In the pixel circuit 15, the voltage Vofs-Vss is set to be larger than the threshold voltage Vth of the drive transistor Tr2 based on the setting of the voltages Vofs and Vss.

Subsequently, while the power supply drive signal DS rises to the power supply voltage Vcc and the voltage of the signal line DTL is set at the fixed voltage Vofs, the write transistor Tr1 is repeatedly set at the ON state by the write signal WS in the pixel circuit 15. Thus, in the pixel circuit 15, while the gate voltage Vg of the drive transistor Tr2 is set at the fixed voltage Vofs, the inter-terminal voltage of the storage capacitor Cs is discharged via the drive transistor Tr2 so that the inter-terminal voltage of the storage capacitor Cs is set at the threshold voltage Vth of the drive transistor Tr2.

Thereafter, at point t2 where the voltage of the signal line DTL is set at the corresponding tone setting voltage (=Vin+Vofs), the write transistor Tr1 is switched to the ON state by the write signal WS in the pixel circuit 15 (FIG. 10C) and the gate voltage Vg of the drive transistor Tr2 is set at the tone setting voltage Vsig set for the signal line DTL (FIG. 10E).

Thus, in the pixel circuit 15, the gate/source voltage Vgs of the drive transistor Tr2 is set at a voltage obtained by adding the threshold voltage Vth of the drive transistor Tr2 to the tone voltage Vin. Thus, the pixel circuit 15 can effectively correct the variation in the threshold voltage Vth of the drive transistor Tr2 to drive the organic EL device 8, thereby preventing a deterioration in image quality due to the variation in the light emission luminance of the organic EL device 8.

In the pixel circuit 15, when the gate voltage Vg of the drive transistor Tr2 is set at the tone setting voltage Vsig, the gate of the drive transistor Tr2 is connected to the signal line DTL for a certain period of time while the drain voltage of the drive transistor Tr2 is held at the power supply voltage Vcc. Thus, in the pixel circuit 15, the inter-terminal voltage of the storage capacitor Cs is discharged at a charge current corresponding to the mobility of the drive transistor Tr2 and the variation in the mobility μ of the drive transistor Tr2 is corrected.

FIG. 10 shows, by symbol "A", a period when the inter-terminal voltage of the storage capacitor Cs is set at the threshold voltage Vth or more of the drive transistor Tr2 by the write signal WS. A period when the inter-terminal voltage of the storage capacitor Cs is set at the threshold voltage Vth of the drive transistor Tr2 through the discharging by the drive transistor Tr2 is denoted by symbol "B". A period when the mobility correction processing is performed to set the light emission luminance is denoted by symbol "C". There may be simultaneously performed a processing of rising the power supply drive signal DS to the power supply voltage Vcc before the start of the period denoted by symbol "A" and setting the inter-terminal voltage of the storage capacitor Cs at the threshold voltage Vth or more of the drive transistor Tr2 and a processing of setting the inter-terminal voltage of the storage capacitor Cs at the threshold voltage Vth of the drive transistor Tr2 through the discharging by the drive transistor Tr2.

[Control of Pixel Circuit by Scan Line]

In the pixel circuit 15 described for FIG. 10, after the inter-terminal voltage of the storage capacitor is set at the threshold voltage of the drive transistor Tr2, at the start of the light emission period, the gate-end voltage of the storage capacitor Cs is set at the voltage of the signal line DTL to set the light emission luminance of the organic EL device 18. During the period T after the light non-emission period starts and until the threshold voltage correction processing starts, the supply from the power supply Vcc to the drive transistor Tr2 is stopped and controlled.

Therefore, during the period T after the light non-emission period starts and until the threshold voltage correction processing starts, even when the inter-terminal voltage of the storage capacitor variously changes while the write transistor Tr1 is being set at the ON state, the light emission luminance in the lasting light emission period is not influenced at all.

The image display apparatus 11 rises to the power supply voltage Vcc in a timesharing for odd line power supply drive signals DS[1], . . . , DS[2*n*-1], . . . (FIGS. 1B and 1E) and their subsequent even line power supply drive signals DS[2], DS[2*n*], . . . (FIGS. 1D and 1G) as shown in FIG. 1 based on the comparison with FIG. 10. Further, the power supply drive signals DS[1], . . . , DS[2*n*-1], . . . and DS[2], . . . , DS[2*n*], . . . are generated so as to sequentially delay by two horizontal scan periods in the continuous lines. FIG. 1 shows the order of lines from the raster scan start end in parentheses. The light emission period is denoted by symbol "TL".

The time division setting is performed by the write signal WS so as to correspond to the time division setting in the drive signal DS, thereby sharing the write signal WS between the odd lines and their subsequent even lines (FIGS. 1C and 1F).

In other words, in the example of FIG. 1, the processing at the start of the light emission period is sequentially performed to be delayed by two horizontal scan periods in the continuous odd lines, and the period when the processing at the start of the light emission period is performed and its subsequent light emission period TL are set at substantially ½ of one-field period. The processing at the start of the light emission period includes the threshold voltage correction processing, the mobility correction processing and the tone setting processing. The remaining ½-field period is set at the light non-emission period.

Similarly, the processing at the start of the light emission period is sequentially performed to be delayed by two horizontal scan periods in the continuous even lines, and the period when the processing at the start of the light emission period is performed and its subsequent light emission period TL are set at substantially ½ of one-field period. The remaining ½-field period is set at the light non-emission period. Thus, in the example of FIG. 1, the tone of each pixel circuit 15 is line-sequentially set in the interlace system.

Figure 11:
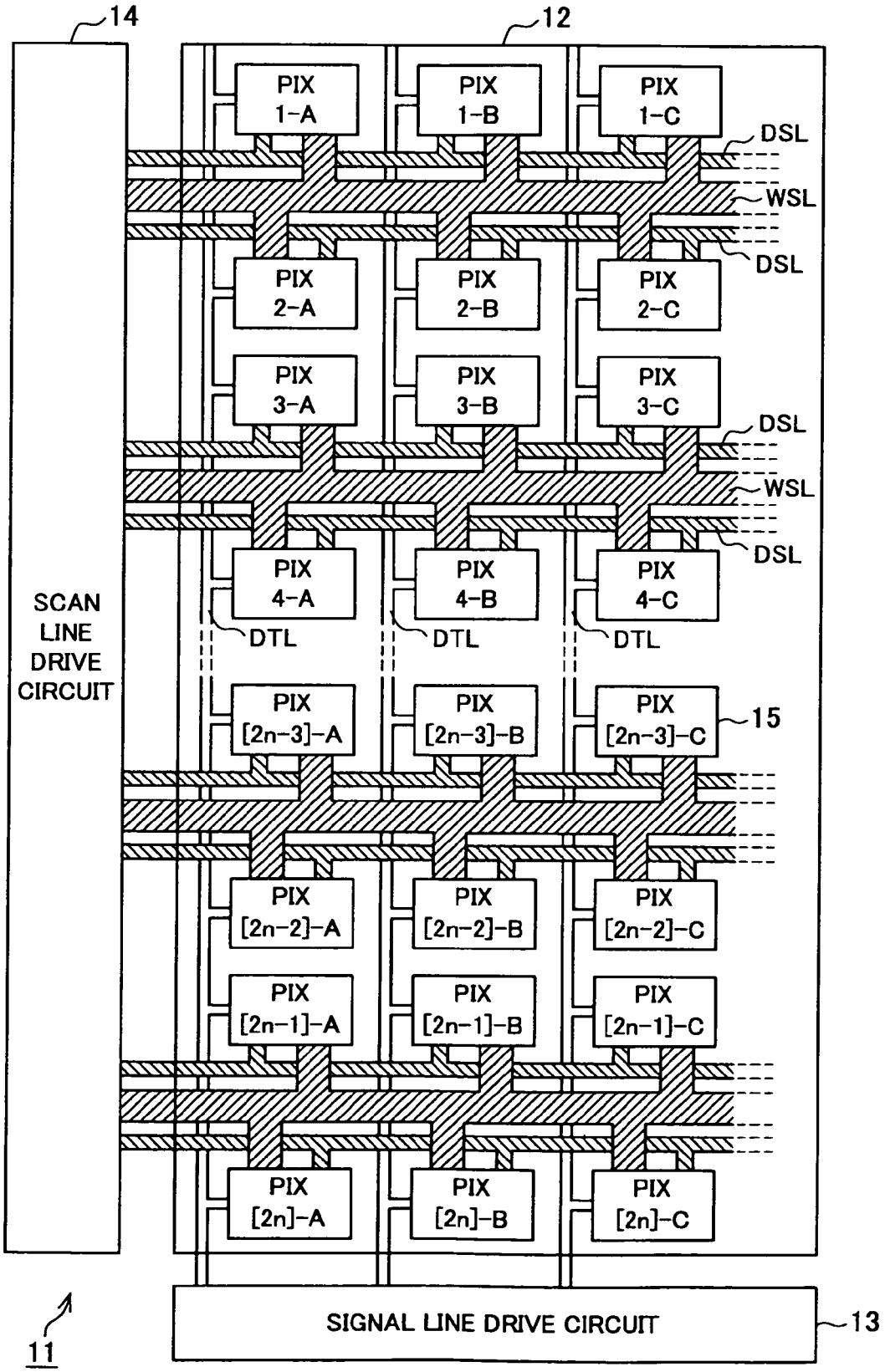
FIG. 11 is a plan view showing a layout of a display unit.

FIG. 11 is a plan view showing a specific layout of the display unit 12. In the display unit 12, the scan lines DSL of the pixel circuits 15 for odd lines and their subsequent even lines, and the common scan lines WSL of the pixel circuits 15 for odd lines and their subsequent even lines are arranged between the pixel circuits for the odd lines and the pixel circuits for their subsequent even lines.

Figure 12:
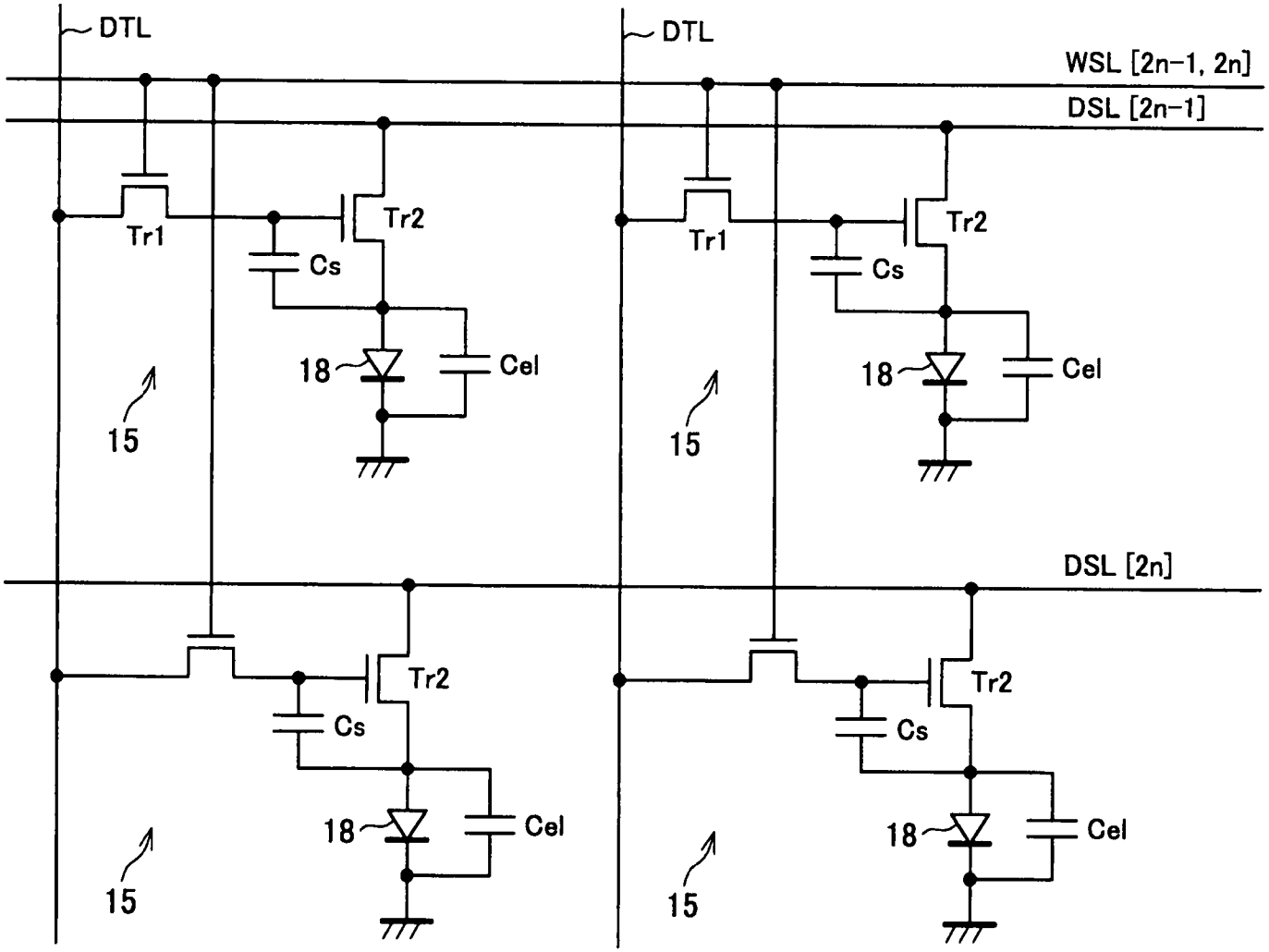
FIG. 12 is a connection diagram corresponding to the layout of FIG. 11.

Consequently, the display unit 12 can form the scan line WSL for the write signal WS to be wider than when the scan line WSL for the write signal WS is arranged for each line, thereby reducing an impedance of the scan line WSL. FIG. 12 is a diagram showing a connection of continuous pixel circuits 5 based on the layout of FIG. 11.

Operation of Embodiment

With the above configuration, in the image display apparatus 11, the sequentially-input image data D1 (FIGS. 2 and 3) is divided into the signal lines DTL in the scan line drive circuit 13 and then is subjected to the D/A conversion processing to be converted into the tone voltage Vin. In the image display apparatus 11, the drive signal Ssig of each signal line DTL is generated by the tone voltage Vin. In the image display apparatus 11, the inter-terminal voltage of the storage capacitor Cs provided in each pixel circuit 15 is set at a voltage corresponding to the drive signal Ssig through the control of the write transistor Tr1 by the write signal WS output from the scan line drive circuit 14. The organic EL device 8 is driven at the drive transistor Tr2 by the gate/source voltage due to the inter-terminal voltage of the storage capacitor Cs through the control of the drive transistor Tr2 by the power supply drive signal DS output from the scan line drive circuit 14. Thus, in the image display apparatus 11, the image based on the image data D1 can be displayed on the display unit 2.

More specifically, in the pixel circuit 15 (FIGS. 4 to 9), the organic EL device 8 is current-driven by the drive transistor Tr2 having the source follower circuit configuration. In the pixel circuit 15, the gate-end voltage of the storage capacitor Cs provided between the gate and the source of the drive transistor Tr2 is set at the voltage Vsig corresponding to the tone voltage Vin. Thus, in the image display apparatus 11, the organic EL device 8 emits a light due to the light emission luminance corresponding to the tone data D1 to display a desired image.

However, the drive transistor Tr2 applied to the pixel circuit 15 has a drawback that a variation in the threshold voltage Vth is large. Consequently, in the image display apparatus 11, when the gate-end voltage of the storage capacitor Cs is simply set at the voltage Vsig corresponding to the tone voltage Vin in each pixel circuit 15, the variation in the threshold voltage Vth of the drive transistor Tr2 causes the variation in the light emission luminance of the organic EL device 8, which deteriorates the image quality.

In the image display apparatus 11, the light non-emission period starts in response to the falling of the power supply drive signal DS, and the end voltage of the organic EL device 8 of the storage capacitor Cs further falls down (FIG. 10). Thereafter, the gate-end voltage of the storage capacitor Cs is set at the fixed voltage Vofs for the threshold voltage correction via the write transistor Tr1 (FIG. 10, symbol "A"). Thus, in the image display apparatus 11, the inter-terminal voltage of the storage capacitor Cs is set at the threshold voltage Vth or more of the drive transistor Tr2. The inter-terminal voltage of the storage capacitor Cs is discharged via the drive transistor Tr2 (FIG. 10, symbol "B"). Through a series of processings, in the image display apparatus 11, the inter-terminal voltage of the storage capacitor Cs is previously set at the threshold voltage Vth of the drive transistor Tr2.

Thereafter, in the image display apparatus 11, the tone setting voltage Vsig obtained by adding the fixed voltage Vofs to the tone voltage Vin is set at the gate voltage of the drive transistor Tr2 (FIG. 10, symbol "C"). Thus, in the image display apparatus 11, it is possible to prevent a deterioration in image quality due to the variation in the threshold voltage Vth of the drive transistor Tr2.

For a certain period of time, the gate voltage of the drive transistor Tr2 is held at the tone setting voltage Vsig while the power is supplied to the drive transistor Tr2, thereby preventing a deterioration in image quality due to the variation in the mobility of the drive transistor Tr2.

Figure 14:
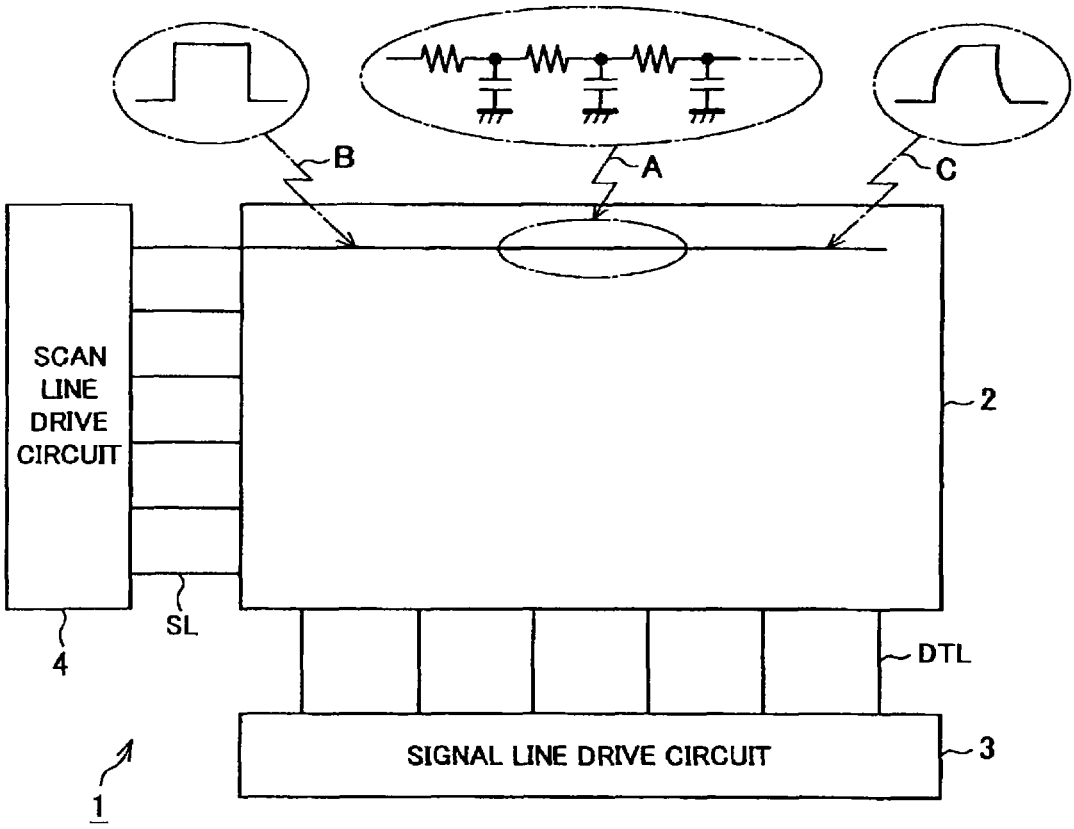
FIG. 14 RELATED ART
FIG. 14 is a diagram for explaining shading.

In the image display apparatus 11, the light emission luminance is set through the control of the write transistor Tr1 by the write signal WS to correct the variations in the threshold voltage and the mobility of the drive transistor Tr2. However, the write signal WS dulls the signal waveform in the process of the transmission in the scan line WSL (FIG. 14). Consequently, shading can occur in the image display apparatus 11.

On the contrary, in the image display apparatus (FIG. 1), in each pixel circuit 15, the gate-end voltage of the storage capacitor Cs is set at the voltage of the signal line DTL to set the light emission luminance of the organic EL device 18 at the start of the light emission period. During the period after the light non-emission period starts and until the threshold voltage correction processing starts, the power supply drive signal DS falls down to the voltage Vss. Therefore, in the image display apparatus 11, during the period after the light non-emission period starts and until the threshold voltage correction processing starts (FIG. 11, T), even when the write transistor Tr1 is set at the ON state, the light emission luminance in the subsequent light emission period is not influenced at all.

In the image display apparatus 11, the power supply drive signal for odd lines and the power supply drive signal for even lines rise to the power supply voltage Vcc in a timesharing, and correspondingly the setting by the write signal WS is performed in a timesharing and the write signal WS is shared between the odd lines and their subsequent even lines. Thus, in the image display apparatus 11, the line width of the scan line WSL for transmitting the write signal WS can be created to be wider than ever before, and the impedance of the scan line WSL can be reduced than ever before.

Figures 13A, 13B, 13C, 13D, 13E:
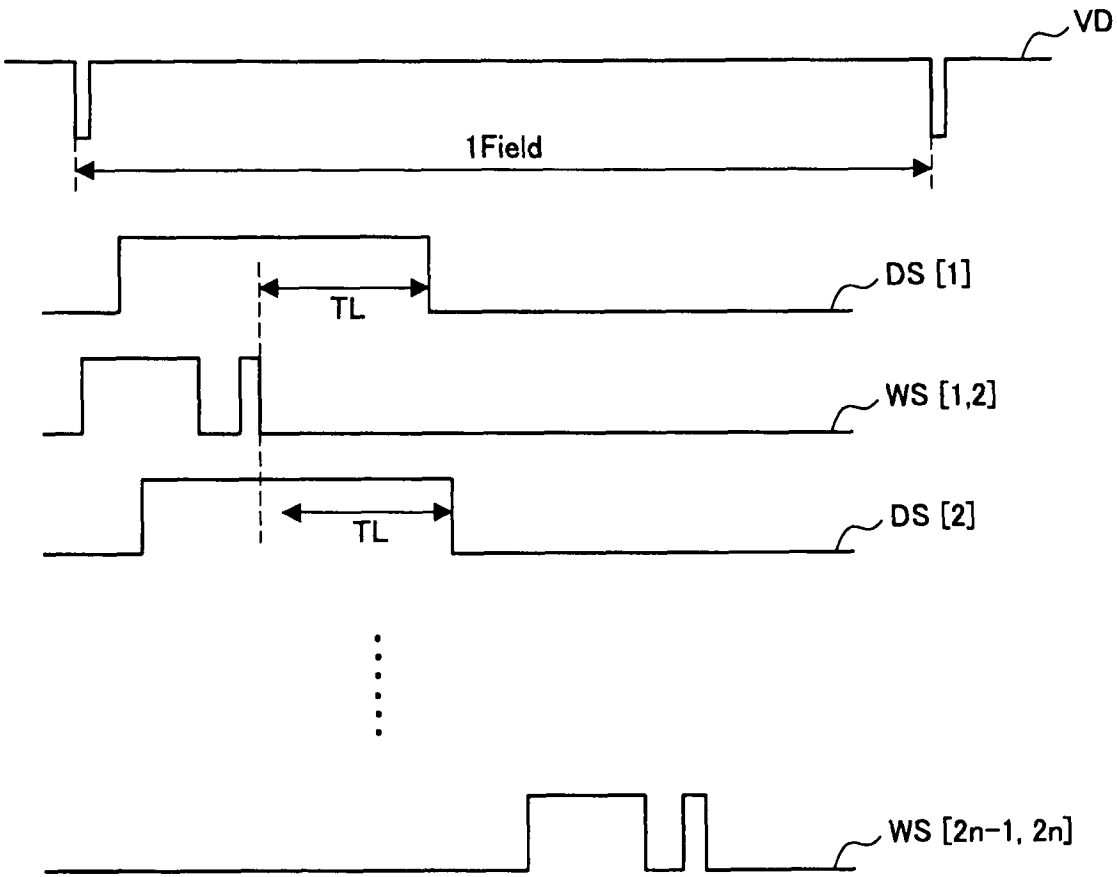
FIGS. 13A-13E are time charts for explaining an operation when scan lines are simply shared.

In other words, as shown in FIG. 13 based on the comparison with FIG. 1, when only the write signal WS [1, 2] is shared between the continuous odd lines and even lines, the pixel circuits 15 for the two continuous lines are simultaneously set at the same tone. The falling of the power supply drive signals DS[1] and DS[2] is different by one horizontal scan period between the two lines, and a difference in luminance occurs between the two lines. Therefore, in this case, when the scan line WS is shared between the two continuous lines, the resolution in the vertical direction reduces by ½, and the light emission luminance is different between the lines. However, in the image display apparatus 11, the two continuous lines are driven in a timesharing so that the number of scan lines WS can be reduced and the line width of the scan line WSL can be increased without the deterioration in resolution in the vertical direction and the difference in light emission luminance between the lines.

When the scan line width when the scan line WSL is arranged for each line is assumed as "d" and the line width for sharing and increasing the scan line WSL between the continuous lines is assumed as Δd, the resistance value Rws of the shared scan line WSL can be expressed as the following Formula. Thus, the resistance value Rws of the scan line WSL can be reduced by the sharing of the scan line. Therefore, a margin for the shading can be increased correspondingly. "R" denotes a resistance value of the scan line WSL when the scan line WSL is arranged for each line.

$$R_{WS} = R \cdot \left( \frac{l}{d + \Delta d} \right) \quad \text{[Formula 2]}$$

The number of scan lines can be reduced to half so that the area occupied by the scan lines WSL in the display unit 12 can be reduced, thereby improving yield and productivity. In other words, in this case, the line width of the scan line WSL is set at the shading visual limit from the Formula (2) so that the rate of the scan lines WS occupying the display unit 12 can be reduced and a short circuit between the scan lines and other lines in the pixel can be prevented.

Further, the layout of the pixel circuit can be simplified and the degree of freedom for design can be remarkably improved than before. In other words, the line width of the scan line is set to be narrower than the shading visual limit, thereby providing a margin to the scan line width design against the shading.

The configuration of the scan line drive circuit 14 can be simplified. The number of terminals in the integrated circuit constituting the scan line drive circuit 14 can be reduced, thereby improving productivity and yield. The light non-emission period occupies substantially half the period, thereby enlarging a black-displayed time to improve contrast than ever before.

Effects of Embodiment

With the above configuration, the power supply drive signal is set at the power supply voltage in a timesharing between the odd lines and their subsequent even lines and the write signal is set to correspond to the time division setting to share the scan lines of the write signal between the odd lines and their subsequent even lines, thereby reducing an impedance of the scan lines than before.

The threshold voltage correction processing is performed on the drive transistor to set the tone setting voltage, thereby effectively avoiding the deterioration in image quality due to the variation in the threshold voltage of the drive transistor.

<Variants>

There has been described the case in which the light non-emission period starts in response to the falling of the power supply drive signal in the embodiment described above, but the present invention is not limited thereto, and the gate-end voltage of the storage capacitor may be set at the fixed voltage Vofs or less for the threshold voltage correction through the control of the write transistor by the write signal to start the light non-emission period.

There has been described the case in which the processing of correcting the variations in threshold voltage and mobility of the drive transistor is performed as shown in FIG. 10 based on the basic configuration described above in FIG. 4 in the above embodiment, but the present invention is not limited thereto, and each pixel circuit may be configure to have the above basic configuration in FIG. 4 when sufficient properties for practice can be secured, and the light emission period and the light non-emission period may be alternately repeated through the control of the drain voltage of the drive transistor by the power supply drive signal.

There has been described the case in which the discharging of the inter-terminal voltage of the storage capacitor is performed via the drive transistor in several periods in the above embodiment, but the present invention is not limited thereto and can be widely applied to the case in which the discharge processing is performed in one period.

There has been described the case in which an N-channel transistor is applied to the drive transistor in the above embodiment, but the present invention is not limited thereto and can be widely applied to the image display apparatus and the like in which a P-channel transistor is applied to the drive transistor.

There has been described the case in which the present invention is applied to the image display apparatus using organic EL devices in the above embodiment, but the present invention is not limited thereto and can be widely applied to a current-driven image display apparatus using various spontaneous light emission devices.

The present invention can be applied to an active matrix image display apparatus using organic EL devices, for example.

The present application contains subject matter related to that disclosed in Japanese Priority Patent Application JP 2008-223226 filed in the Japan Patent Office on Sep. 1, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image display apparatus comprising:

a first power supply scan line directly electrically connected to a source/drain of a first row drive transistor, said first power supply scan line extending along a scan line direction;

a second power supply scan line directly electrically connected to a source/drain of a second row drive transistor, said second power supply scan line extending along said scan line direction;

a signal line directly electrically connected to a source/drain of a first row write transistor and a source/drain of a second row write transistor, said signal line extending along a direction other than said scan line direction;

a write signal scan line directly electrically connected to a gate of the first row write transistor and a gate of the second row write transistor, said write signal scan line being between said first power supply scan line and said second power supply scan line.

2. The image display apparatus according to claim 1, wherein an electrical connection from said write signal scan line to said source/drain of the first row drive transistor intersects said first power supply scan line.

3. The image display apparatus according to claim 2, wherein an electrical connection from said write signal scan line to said source/drain of the second row drive transistor intersects said second power supply scan line.

4. The image display apparatus according to claim 1, wherein said write signal scan line extends along said scan line direction.

5. The image display apparatus according to claim 1, wherein said first power supply scan line is between said write signal scan line and a first pixel circuit, said first row drive transistor and said first row write transistor being within said first pixel circuit.

6. The image display apparatus according to claim 5, wherein said second power supply scan line is between said write signal scan line and a second pixel circuit, said second row drive transistor and said second row write transistor being within said second pixel circuit.

7. The image display apparatus according to claim 1, wherein said first row drive transistor is configurable to provide electrical connection and disconnection between said first power supply scan line and a first light emission device.

8. The image display apparatus according to claim 7, wherein said second row drive transistor is configurable to provide electrical connection and disconnection between said second power supply scan line and a second light emission device.

9. The image display apparatus according to claim 1, wherein said first row write transistor is configurable to provide electrical connection and disconnection between said signal line and said first row drive transistor.

10. The image display apparatus according to claim 1, wherein a write signal on the write signal scan line controls said first row write transistor to provide said electrical connection and disconnection between said signal line and said first row drive transistor.

11. The image display apparatus according to claim 10, wherein said second row write transistor is configurable to provide electrical connection and disconnection between said signal line and said second row drive transistor.

12. The image display apparatus according to claim 1, further comprising:

a scan line drive circuit configured to output a tone setting write signal onto said write signal scan line after outputting a correction write signal onto said write signal, said tone setting voltage being a sum of a voltage at the first electrode and a voltage at the second electrode.

13. The image display apparatus according to claim 12, wherein said first power supply scan line and said second power supply scan line are directly electrically connected to said scan line drive circuit, said scan line drive circuit being directly electrically connected to said write signal scan line.

14. The image display apparatus according to claim 12, wherein said first row write transistor is configured to perform a transfer of a tone setting voltage from said signal line to said gate of the first drive transistor, said tone setting write signal controlling said transfer of the tone setting voltage.

15. The image display apparatus according to claim 14, wherein said scan line drive circuit is configured to output a power supply voltage onto said first power supply scan line while controlling said first row write transistor to provide said tone setting voltage from said signal line to said gate of the first drive transistor.

16. The image display apparatus according to claim 12, wherein said first row write transistor is configured to perform a transfer of a correction voltage from said signal line to said gate of the first row drive transistor when a first power supply drive signal on said first power supply scan line is at a fixed voltage.

17. The image display apparatus according to claim 16, wherein a voltage level of the correction voltage is not less than a threshold voltage of the first row drive transistor.

18. The image display apparatus according to claim 16, wherein said scan line drive circuit is configured to change a voltage on the second power supply scan line from said power supply voltage to said fixed voltage.

19. The image display apparatus according to claim 16, wherein said fixed voltage is lower than said power supply voltage.

20. The image display apparatus according to claim 16, wherein said first power supply drive signal is at said fixed voltage during a light non-emission period, light emission luminance from said first light emission device being non-emissible during said light non-emission period.

21. The image display apparatus according to claim 20, wherein said scan line drive circuit is configured to start said light non-emission period by changing said first power supply drive signal from said power supply voltage to said fixed voltage.

22. The image display apparatus according to claim 16, wherein a capacitor is dischargeable while said correction voltage is provided said gate of the first row drive transistor.

23. The image display apparatus according to claim 22, wherein a source/drain of the first row drive transistor is directly electrically connected to an electrode of the capacitor, another electrode of the capacitor and a drain/source of the first row write transistor being electrically connected to said gate of the first row drive transistor.

* * * * *